United States Patent [19]

Yoshimura et al.

[11] Patent Number: 5,075,024

[45] Date of Patent: Dec. 24, 1991

[54] SYNTHETIC TRACTION FLUID

[75] Inventors: Narihiko Yoshimura; Hirotaka Tomizawa; Yasuji Komatsu, all of Saitama, Japan

[73] Assignee: Toa Nenryo Kogyo, K.K., Tokyo, Japan

[21] Appl. No.: 274,986

[22] Filed: Nov. 22, 1988

Related U.S. Application Data

[63] Continuation of Ser. No. 55,238, May 28, 1987.

[30] Foreign Application Priority Data

Jun. 2, 1986 [JP] Japan ..... 61-127642

[51] Int. Cl.[5] ..... C10M 105/34

[52] U.S. Cl. ..... 252/79; 252/56 S; 560/1; 560/193

[58] Field of Search ..... 252/79, 52 R, 56 S; 560/1, 193

[56] References Cited

U.S. PATENT DOCUMENTS 2,807,638 9/1957 Morris et al. ..... 524/285
3,803,037 4/1974 Wygant ..... 252/32.7

FOREIGN PATENT DOCUMENTS 1593113 7/1981 United Kingdom .

*Primary Examiner*—Paul Lieberman
*Assistant Examiner*—Christine A. Skane
*Attorney, Agent, or Firm*—R. A. Maggio

[57] ABSTRACT

A synthetic traction fluid comprising, as a base oil, at least one ester or its derivative selected from monoesters or their derivatives, and triesters or their derivatives represented by the formula

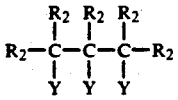

wherein Y is independently selected from

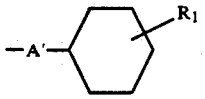

and —OH with A' being an ester linkage and $R_1$ being independently selected from hydrogen and $C_1$ to $C_8$ alkyl groups, with the proviso that at least one Y is

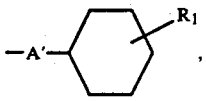

and $R_2$ is independently selected from hydrogen and $C_1$ to $C_3$ alkyl groups.

11 Claims, No Drawings

SYNTHETIC TRACTION FLUID

This is a continuation of application Ser. No. 055,238, filed May 28, 1987.

FIELD OF THE INVENTION

This invention relates to a synthetic traction fluid. More particularly, the present invention is concerned with a synthetic traction fluid comprising an ester or its derivative having 1 to 3 cyclohexyl rings as the base oil.

BACKGROUND OF THE INVENTION

Traction drive power transmissions which transmit power to a driven part through a traction drive mechanism have attracted attention in the field of automobiles or industrial machinery, and in recent years research and development thereon have advanced. The traction drive mechanism is a power transmitting mechanism. Unlike conventional drive mechanisms it does not use any gears, which enables reduction of vibration and noise as well as providing a smooth speed change in high-speed rotation. An important goal in the automobile industry is an improvement in the fuel consumption of automobiles. It has been suggested that if the traction drive is applied to the transmission of automobiles to convert the transmission to the continuous variable-speed transmission the fuel consumption can be reduced by at least 20% compared to conventional transmission systems, since the drive can be always be in the optimum-fuel consumption region of an engine. Recent studies have resulted in the development of materials having high fatigue resistance as well as in theoretical analysis of traction mechanisms. As regards the traction fluid, the correlation of traction coefficients is gradually being understood on a level of the molecular structure of the components. The term "traction coefficient" as used herein is defined as the ratio of the tractional force which is caused by slipping at the contact points between rotators which are in contact with each other in a power transmission of the rolling friction type to the normal load.

The traction fluid is required to be comprised of a lubricating oil having a high traction coefficient. It has been confirmed that a traction fluid possessing a molecular structure having a naphthene ring exhibits a high performance. "Santotrack®" manufactured by the Monsanto Chemical Company is widely known as a commercially available traction fluid. Japanese Patent Publication No. 35763/1972 discloses di(cyclohexyl)alkane and dicyclohexane as traction fluids having a naphthene ring. This patent publication discloses that a fluid obtained by incorporating the above-mentioned alkane compound in perhydrogenated (α-methyl)styrene polymer, hydrindane compound or the like has a high traction coefficient. Further, Japanese Patent Laid-Open No. 191797/1984 discloses a traction fluid containing an ester compound having a naphthene ring. It discloses that an ester obtained by the hydrogenation of the aromatic nucleus of dicyclohexyl cyclohexanedicarboxylate or dicyclohexyl phthalate is preferred as the traction fluid.

As mentioned above, the development of continuous variable-speed transmissions has progressed in recent years. The higher the traction coefficient of the traction fluid the larger the allowable transmission force in the same device. This contributes to a reduction in the size of the entire device resulting in a reduction in the emission of polluting exhaust gases. Therefore, there is a strong demand for a fluid having a traction coefficient which is as high as possible. However, the use of a traction fluid which exhibits the highest performance of all the currently commercially available fluids in such a traction drive device gives unsatisfactory performance with respect to the traction coefficient, and is also rather expensive. The traction fluid which has been proposed in Japanese Patent Publication No. 35763/1971 contains Santotrack or its analogue as a component and, therefore, is also unsatisfactory with respect to its performance and cost.

The present inventors have made extensive and intensive studies with a view to developing a traction fluid which not only exhibits a high traction coefficient but is also relatively inexpensive. As a result, the present inventors have found that the incorporation of an ester or its derivative having 1 to 3 cyclohexyl rings can provide an economical high-performance base oil fluid. The present invention has been made based on this finding.

SUMMARY OF THE INVENTION

A synthetic traction fluid comprising, as a base oil, an ester or its derivative represented by the formula

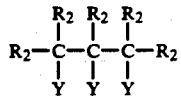

wherein Y is independently selected from

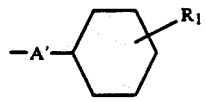

or —OH wherein A' is an ester bond and $R_1$ is independently selected from hydrogen and $C_1$ to $C_8$ alkyl groups, with the proviso that at least one Y is

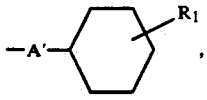

and $R_2$ is independently selected from hydrogen and $C_1$ to $C_3$ alkyl groups. The synthetic traction fluid may also additionally optionally contain at least one compound selected from branched poly-α-olefin or the hydrogenation product thereof, a monoester having two cyclohexyl rings, and a diester having two cyclohexyl rings.

DETAILED DESCRIPTION OF THE INVENTION

According to the present invention there is provided a synthetic traction fluid comprising, as a base oil, a monoester, diester, triester or derivatives thereof represented by the following general formula

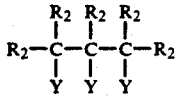

wherein Y is independently

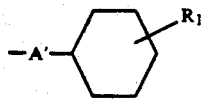

or —OH, A' is an ester linkage of —COO— or —OOC—, $R_1$ may be the same or different and are one to three members selected from a hydrogen atom and alkyl groups having 1 to 8 carbon atoms, with the proviso that at least one Y is

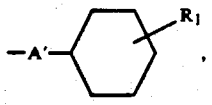

and $R_2$ may be the same or different an are one to three members selected from a hydrogen atom and alkyl groups having 1 to 3 carbon atoms (exclusive of glycerol).

Mixtures of two or more different monoesters, diesters, triesters and derivatives thereof are also included in the present invention.

A first object of the present invention is to provide a high-performance traction fluid having a high traction coefficient. A second object of the present invention is to provide a traction fluid which is not only economical but also readily available and easily applicable to transmissions. The traction fluid of the present invention contains an ester (hereinafter often referred to as "ester A") having 1 to 3 cyclohexyl rings incorporated therein.

The traction fluid of the present invention comprises an ester or its derivative having to 3 cyclohexyl rings and having the above-mentioned structural formula. A' of the ester linkage is —COO— or —OOC—. Specifically, the ester of the present invention comprises either one particular ester or its derivative or a mixture of two or more different esters or their derivatives selected from monoesters, diesters and triesters and their derivatives each having 1 to 3 cyclohexyl rings. In the practice of the present invention the triesters are particularly preferred. These esters or derivatives thereof have a viscosity of 50 to 500 cst, particularly preferably 100 to 400 cst at 40° C., and 1 to 20 cst, particularly preferably 5 to 15 cst at 100° C. Examples of the derivatives of the esters include their amination products and ether compounds.

The esters can be prepared by any of the following methods. The first method comprises an esterification reaction of a trihydric alcohol with a cyclohexane-carboxylic acid compound. The trihydric alcohol has 3 to 18 carbon atoms, preferably 3 to 9 carbon atoms. Specifically, examples of the trihydric alcohols include glycerol, 1-methyl-1,2,3-propanetriol, and 1,3=dimethyl-1,2,3-propanetriol. Examples of the cyclohexanecarboxylic acid compounds include, besides cyclohexanecarboxylic acid, those having an alkyl group with 1 to 8 carbon atoms, e.g., methylcyclo-hexane-carboxylic acid, ethylcyclohexanecarboxylic acid, etc. Cyclohexanecarboxylic acid is particularly preferred. The esterification reaction is conducted in an alcohol/acid molar ratio of 1:3 or in the presence of an excess amount of the acid. The former method requires the use of a catalyst. Therefore, it is preferred that the esterification reaction be conducted in the presence of an excess amount of the acid. Specifically,1 mol of the dihydric alcohol is reacted with the acid in 1 to 5-fold mol excess (particularly preferred in 1.5 to 4-fold mol excess). The reaction temperature is about 150° to 250° C., preferably 170° to 230° C.,and the reaction time is 10 to 40 hrs., preferably 15 to 25 hrs. Although the esterification reaction may be conducted under either elevated or reduced pressures, it is preferred that the reaction be conducted at atmospheric pressure from the standpoint of ease of reaction operation. Under this condition the excess acid serves as a catalyst. An alkylbenzene such as xylene or toluene can be added in a suitable amount as a solvent. The addition of the solvent enables the reaction temperature to be easily controlled. As the reaction proceeds water which has been formed during the reaction evaporates. The reaction is terminated when the amount of the water reaches a level of 3 moles per mol of the alcohol. The excess acid is neutralized with an aqueous alkaline solution and removed by washing with water. When an acid which is difficult to extract with an alkali washing is used the reaction is conducted using the acid in an amount of 1.5 to 3.5-fold mol excess over the alcohol in the presence of a catalyst. Examples of the catalyst include phosphoric acid, p-toluenesulfonic acid and sulfuric acid. The most preferred catalyst is phosphoric acid because it enhances the reaction rate and increases the yield of the ester. The reaction product is finally distilled under reduced pressure to remove water and the solvent, thereby obtaining the ester compound of the present invention.

The second method of producing the ester comprises esterification of a cyclohexanol compound with a tricarboxylic acid having 6 to 21 carbon atoms. Examples of the cyclohexanol compounds include, besides cyclohexanol, those having an alkyl group with 1 to 8 carbon atoms, e.g., methylcyclohexanol and te rt-butylcyclohexanol. Cyclohexanol is particularly preferred. The tricarboxylic acid includes one having 3 to 5 carbon atoms in its main chain, preferably one having 3 carbon atoms in its main chain. The esterification reaction is conducted in an alcohol/acid molar ratio of 3:1 or in the presence of an excess amount of the alcohol. It is preferred that the esterification reaction be conducted in the presence of an excess amount of the alcohol. Specifically, 1 mol of the tricarboxylic acid is reacted with the alcohol in 3 to 5-fold mol excess. The reaction temperature is about 150 to 250° C., preferably 170° to 230° C., and the reaction time is 10 to 40 hrs., preferably 15 to 25 hrs. Although the esterification reaction may be conducted under either elevated or reduced pressures, it is preferred that the reaction be conducted at atmospheric pressure from the standpoint of ease of reaction operation. An alkylbenzene such as xylene or toluene can be added in a suitable amount as a solvent. The addition of the solvent enables the reaction temperature to be easily controlled. As the reaction proceeds, water which has been formed during the reaction evaporates. The reaction is terminated when the amount of the water reaches three times, by mol, that of the tricarboxylic acid. Phosphoric acid, p-toluenesulfonic acid or sulfuric acid is used as a catalyst. The most preferable catalyst is phosphoric acid because it enhances the reaction rate and increases the yield of the ester. The reaction product is finally distilled under reduced pressure to remove the water, solvent and excess alcohol, thereby obtaining the ester compound of the present invention. It is noted in this connection that the terminal carboxyl group of the monoester or diester prepared by this method is unstable. Therefore, it is necessary to convert the ester into its derivative such as a salt.

The esters of the present invention exhibit a high traction coefficient even when used alone. Furthermore, the incorporation of a viscosity modifier, such as poly-α-olefin, or another ester as a second component provides a further improvement in traction coefficient.

The poly-α-olefin which is used as the second component has either a quaternary carbon atom or a tertiary carbon atom in its main chain and is a polymer of an α-olefin having 3 to 5 carbon atoms or the hydrogenation product thereof. Examples of the poly-α-olefins include polypropylene, polybutene, polyisobutylene and polypentene and the hydrogenation products thereof. Particularly preferred are polybutene and polyisobutylene and the hydrogenation products thereof. The polyisobutylene is represented by the following structural formula:

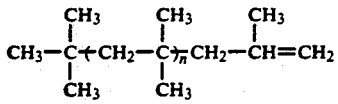

The hydrogenation product of the polyisobutylene is represented by the following structural formula:

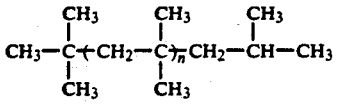

In the above formulae the degree of polymerization n is 5 to 150.

Although the polybutene and polyisobutylene may be commercially available ones, they may also be produced by conventional polymerization methods. The hydrogenation product thereof is produced by reacting polyisobutylene or the like in the presence of hydrogen. The molecular weight of the poly-α-olefin is preferably in the range of 300 to 8,500, more preferably in the range of 500 to 3,000. The molecular weight can be adjusted by suitable methods such as decomposition of a poly-α-olefin having a high molecular weight and mixing of poly-α-olefins having different molecular weights. Although an α-olefin copolymer (OCP) is a kind of a poly-α-olefin, it is unsuited for use as the second component in the present invention. This is because OCP is obtained by polymerization of two or more α-olefins and has a structure wherein these α-olefins are irregularly linked, as opposed to the polybutene, etc. which has a regular gem-dialkyl structure. In the present invention, an ester having at least two cyclohexyl rings and one or two ester linkages (hereinafter referred to as "ester B") is used as the second component. Examples of the ester B include a monoester or diester obtained by the esterification of a cyclohexanol compound with a carboxylic acid. A particularly preferable ester B is a monoester or diester having 1 to 10 carbon atoms in its center and having one cyclohexyl ring at each end.

The detailed structure and process for preparation of the ester B are described in Japanese Patent Application Nos. 27832/1985, 294424/ 1985, and 19226/1986, by the same inventors as in the instant application, all of which are incorporated herein by reference.

The ester of the present invention, e.g., a triester of glycerol with cyclohexanol, exhibits a traction coefficient of 0.099 to 0.101; the second component, e.g., polybutene, exhibits a traction coefficient of 0.075 to 0.085; and the ester B (a monoester of cyclohexane-carboxylic acid with cyclohexanol) exhibits a traction coefficient of 0.090 to 0.092.

Since the ester (first component) of the present invention exhibits a high traction coefficient, the use of this ester alone in a traction drive device results in a high performance. However, a further improved traction fluid can be obtained by blending the first component with 0.1 to 95% by weight, particularly 10 to 70% by weight, of the second component comprised of a poly-α-olefin or ester B. Specifically, although the traction coefficient of the second component is lower than or equal to that of component A, the gem-dialkyl group or cyclohexyl ring of the second component cooperates with the cyclohexyl ring of the first component to exhibit a synergistic effect in improving the traction coefficient. Furthermore, since the second component is relatively inexpensive and exhibits excellent viscosity characteristics a traction fluid can be economically obtained by blending the first component with 0.1 to 95% by weight of the second component without lowering the traction coefficient.

Various additives may also be added to the synthetic traction fluid of the present invention depending upon its use. Specifically, when the traction device undergoes a high temperature and a large load at least one additive selected from an antioxidant, a wear inhibitor and a corrosion inhibitor may be added in an amount of 0.01 to 5% by weight. Similarly, when a high viscosity index is required a known viscosity index improver is added in an amount of 1 to 10% by weight. However, the use of poly-methacrylate and olefin copolymer unfavorably lowers the traction coefficient. Therefore, it is preferred that when present they be added in an amount of 4% by weight or less.

The term "traction fluid" as used in the present invention is intended to mean a fluid for use in devices which transmit a rotational torque through spot contact or line contact, or for use in transmissions having a similar structure. The synthetic traction fluid of the present invention exhibits a traction coefficient higher than those of conventionally known fluids, i.e., exhibits a traction coefficient 5 to 15% higher than those of conventional fluids, although the value varies depending on properties such as viscosity. Therefore, the synthetic traction fluid of the present invention can be advantageously used for relatively low power drive transmissions including internal combustion engines of small passenger cars, spinning machines and food producing machines, as well as large power drive transmissions such as industrial machines, etc.

The synthetic traction fluid of the present invention is remarkably superior in traction coefficient to conventional fluids. The reason why the synthetic traction fluid of the present invention exhibits a high traction coefficient is not yet fully understood. However, basically, the reason is believed to reside in the unique molecular structure of the synthetic traction fluid of the present invention.

The synthetic traction fluid (first component) of the present invention comprises an ester having 1 to 3 cyclohexyl rings in its molecule. The 1 to 3 ester linkages bring about an interdipolar force between the molecules. It is believed that the interdipolar force serves to bring the fluid into a stable glassy state under high load conditions, thereby increasing the shearing force. Further, when the ester of the present invention is blended with the second component which has a gem-dialkyl quaternary carbon atom or a cyclohexyl ring, the cyclohexyl ring of the first component is firmly engaged, like gears, with the gem-dialkyl portion of the quaternary carbon atom or cyclohexyl ring of the second component under high-load conditions of the traction device, while when the device is released from the load the engagement is broken thereby causing fluidization.

The following examples are provided for illustrative purposes only and are not to be construed as limiting the invention described herein.

EXAMPLES 1-9

Ester $A_1$ of the present invention was synthesized by the following method. First, cyclohexanecarboxylic acid and glycerol (in a molar ratio of 3.5:1) and toluene as a solvent were charged into a reactor. Then the reactor was heated to 170° C., and the contents of the reactor were allowed to react at a temperature in the range of 170° C. to 230° C. under atmospheric pressure. The heating was stopped at a point when the water generated accompanying the reaction amounted to three times, by mole, of the cyclohexanecarboxylic acid.

The reaction mixture was washed with an alkaline solution to remove unreacted compounds, i.e., cycloexylcarboxylic acid and toluene, from a mixture of the reaction product, i.e., a triester of cyclohexanecarboxylic acid with glycerol, and the unreacted compounds, followed by vacuum distillation, thereby isolating a pure diester $A_1$.

A partial ester $A_2$ of the present invention was synthesized using the following material in the same manner as described above, except that the heating was stopped at a point when the water generated accompanying the reaction amounted to twice by mole of the alcohol.

$A_2$. . . glycerol and cyclohexanecarboxylic acid (an average number of the ester linkages: 2)

Next, the ester $A_1$ or $A_2$ thus produced was blended with polybutene $B_1$ having an average molecular weight of 900, or with any of esters such as $B_2$ to $B_4$, followed by measurement of the traction coefficient. The measurement conditions utilized to determine the traction coefficient are described below.

The esters $B_2$ to $B_4$ were synthesized using the following materials.

$B_2$. . . cyclohexanecarboxylic acid and cyclohexanol
$B_3$. . . malonic acid and cyclohexanol
$B_4$. . . cyclohexanecarboxylic acid and ethylene glycol Measurement conditions:

Measuring equipment:

Soda-type four roller traction test machine.

Testing conditions:

a fluid temperature of 20° C.; a roller temperature of 30° C.; a mean Hertzian pressure of 1.2 GPa; a rolling velocity of 3.6 m/s; and a slipping ratio of 3.0%.

As can be seen from Table 1 the traction fluid of the present invention was found to be remarkably superior in its traction performance to the conventional traction fluids.

COMPARATIVE EXAMPLES 1-4

A traction fluid consisting of any of polybutene alone or ester B alone (i.e., 100 weight percent) and a commerically available traction fluid (Santotrack ®) were used as comparative samples. Traction coefficients of these comparative samples were measured under the same conditions as in the above Examples.

The results are shown in Table 1. As can be seen from Table 1 all the comparative samples exhibited traction coefficients 5 to 15% smaller than that of the synthetic fluid of the present invention.

TABLE 1

| | Loadings of A | Loadings of B | Viscosity (cst) 40° C. | Viscosity (cst) 100° C. | Viscosity index | Traction coefficient |
|---|---|---|---|---|---|---|
| Example | | | | | | |
| 1 | A 100 | — | 164.8 | 11.07 | 14 | 0.100 |
| 2 | A 100 | — | 173.4 | 11.21 | 8 | 0.101 |
| 3 | A 90 | B 10 | 237.8 | 13.9 | 18 | 0.102 |
| 4 | A 50 | B 50 | 22.75 | 3.91 | 29 | 0.107 |
| 5 | A 50 | B 50 | 25.45 | 4.10 | 17 | 0.111 |
| 6 | A 50 | B 50 | 36.26 | 5.26 | 62 | 0.102 |
| 7 | A 50 | B 50 | 23.12 | 3.93 | 25 | 0.105 |
| 8 | A 50 | B 50 | 25.87 | 4.12 | 13 | 0.110 |
| 9 | A 50 | B 50 | 36.26 | 5.26 | 62 | 0.103 |
| Comp. Ex. | | | | | | |
| 1 | — | B | 11600 | 240 | *108 | 0.081 |
| 2 | — | B | 6.38 | 1.92 | 75 | 0.092 |
| 3 | — | B | 12.17 | 2.97 | 93 | 0.089 |
| 4 | Santotrack ® | | 13.8 | 2.99 | 46 | 0.087 |

Note:
*value obtained through calculation using an equation with respect to a kinematic viscosity of 17 to 43 cSt at 100° C.

The traction fluid of the present invention comprising an ester having 1 to 3 cyclohexyl rings and 1 to 3 ester linkages as the base oil not only exhibits an extremely high traction coefficient but is also inexpensive and exhibits excellent viscosity characteristics.

Therefore, the use of the traction fluid of the present invention in a power transmission, particularly a traction drive device, leads to a remarkable increase in shearing force under a high load, which enables the reduction in size of the device and economical supply of the device.

What is claimed is:

1. A synthetic traction fluid comprising (i) at least one ester selected from the group consisting of monoesters diesters of their derivatives, and triesters or derivatives thereof represented by the formula

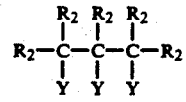

wherein Y is independently selected from

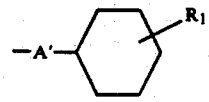

and —OH, with A' being an ester linkage of —COO—or —OCC—and $R_1$ is independently selected from hydrogen and $C_1$ to $C_8$ alkyl groups, and $R_2$ is independently selected from hydrogen and $C_1$ to $C_3$ alkyl groups, with the proviso that at least one Y is

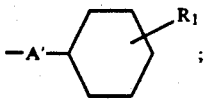

;

and (ii) 0.1 to 95% by weight of the total composition of a poly-α-olefin or hydrogenation product thereof having a molecular weight of from 300 to 8,500.

2. The fluid of claim 1 wherein $R_1$ is independently selected from hydrogen and $C_1$ to $C_4$ alkyl groups.

3. The fluid of claim 2 wherein $R_2$ is independently selected from hydrogen and methyl.

4. The fluid of claim 1 wherein $R_2$ is independently selected from hydrogen and methyl.

5. The fluid of claim 1 which contains from 1 to 70% by weight of said poly-α-olefin or hydrogenation product thereof.

6. The fluid of claim 1 wherein said poly-α-olefin is a branched poly-α-olefin.

7. The fluid of claim 6 which contains from 1 to 70% by weight of said branched poly-α-olefin.

8. The fluid of claim 7 wherein $R_1$ is independently selected from hydrogen and $C_1$ to $C_4$ alkyl groups.

9. The fluid of claim 8 wherein $R_2$ is independently selected from hydrogen and methyl.

10. The fluid of claim 1 wherein said poly-α-olefin or hydrogenation product thereof has a molecular weight of from 500 to 3,000.

11. The fluid of claim 6 wherein said branched poly-α-olefin has a molecular weight of from 500 to 3,000.

* * * * *